United States Patent [19]

Nero

[11] 4,243,913

[45] Jan. 6, 1981

[54] COLOR PICTURE TUBE MAGNETIC SHIELDING AND DEGAUSSING STRUCTURE

[75] Inventor: Leroy W. Nero, Indianapolis, Ind.

[73] Assignee: RCA Corporation, New York, N.Y.

[21] Appl. No.: 70,904

[22] Filed: Aug. 29, 1979

[51] Int. Cl.[3] ..... H01J 29/06

[52] U.S. Cl. ..... 315/8; 315/85; 361/150

[58] Field of Search ..... 315/8, 85; 313/479; 361/150

[56] References Cited

U.S. PATENT DOCUMENTS

| | | | |
|---|---|---|---|
| 3,317,781 | 5/1967 | Barbin et al. | 315/8 |
| 3,322,998 | 5/1967 | Norley | 315/8 |
| 3,576,395 | 4/1971 | Arrington et al. | 315/8 X |
| 3,588,583 | 6/1971 | Ciecierski | 361/150 X |
| 3,867,668 | 2/1975 | Shrader | 315/8 |
| 3,965,386 | 6/1976 | Duistermaat et al. | 315/8 |

*Primary Examiner*—Eugene R. LaRoche
*Attorney, Agent, or Firm*—Eugene M. Whitacre; William H. Meagher; Joseph J. Laks

[57] ABSTRACT

A combined magnetic shielding and degaussing structure for an in-line color picture tube comprises magnetizable shielding plates of an extended surface area each located at a corner of the picture tube and two vertically oriented magnetizable strips. Each strip connects upper and lower corner shielding plates on one side of the picture tube. The shielding plates guide stray magnetic flux into the strips and away from the picture tube interior in order to provide magnetic shielding. A degaussing winding is wound around the vertical axis of each strip and generates a degaussing flux which flows through the shielding plates and into the color picture tube shadow mask.

13 Claims, 3 Drawing Figures

COLOR PICTURE TUBE MAGNETIC SHIELDING AND DEGAUSSING STRUCTURE

BACKGROUND OF THE INVENTION

This invention relates to color picture tube degaussing and shielding apparatus.

In shadow mask type color picture tubes, for example, with three color phosphor groups deposited on a phosphor screen, the deflection yoke causes the three electron beams within the picture tube envelope to be deflected to scan a raster. If the electron beams do not appear to be deflected from the corresponding picture tube deflection centers, errors such as color purity errors arise.

Magnetic fields originating external to the picture tube and its associated magnetic structure, such as the earth's magnetic field or other stray fields, if permitted to intercept the electron beam travel within the picture tube, will undesirably deflect the beams, creating color purity errors. Magnetic shields have been designed which are placed adjacent the picture tube, either external or internal to the envelope, to prevent the stray fields from penetrating the tube sufficiently to significantly affect the electron beam movement.

The metallic mask and its supporting structure together with other metal parts used in conjunction with the shadow mask type of color television picture tube are subject to becoming magnetized both in shipment to, and continued use by, a consumer. Such magnetization occurs when the picture tube is brought into proximity with magnetizing structures such as trucks and elevators, and also when the tube is exposed during use to influences such as the earth's magnetic field. The resultant magnetic field from such magnetizations often adversely affects the picture tube performance.

Automatic degaussing apparatus has been designed which develops a decaying alternating polarity degaussing field which demagnetizes the picture tube metallic structures such as the shadow mask. Such apparatus may be combined with the magnetic shield to provide a combined structure for magnetic shielding and degaussing. To reach the shadow mask, the degaussing flux flows in the metallic shielding elements.

Conventional combined structures typically have required the use of relatively high permeability metal for the shield material in order for the magnetic shield to exhibit a low enough reluctance to be able to couple a sufficient amount of degaussing flux into the shield and the shadow mask to permit adequate degaussing. Combined structures with relatively high reluctance paths to the shadow mask require degaussing coils capable of carrying relatively large degaussing currents. The cross-sectional area of core around which these coils are wound must then be increased to prevent magnetic saturation of the core.

With in-line color picture tubes, only horizontal error movements of the electron beams produce color purity errors. Vertically directed or vertical components of stray magnetic fields develop horizontal movement of the electron beams producing these color purity errors. A combined shielding and degaussing structure should provide shielding particularly effective against these vertical fields and any other stray field components which produce horizontal electron beam motion.

SUMMARY OF THE INVENTION

A magnetic shielding and degaussing structure for a color picture tube having a shadow mask includes a vertically oriented strip of magnetizable material located adjacent a side of the color picture tube.

A first magnetizable shielding plate is connected to an end of the strip and flares outwardly to become wider than the strip at a strip end. The shielding plate covers an extended surface area external to the color picture tube at a corner of the tube over a region of the shadow mask and over a funnel region extending rearwardly from the shadow mask region unshielded by other magnetizable structures within said color picture tube.

A degaussing winding for generating degaussing flux includes conductor turns wound around the vertical axis of the strip of magnetizable material.

DESCRIPTION OF THE INVENTION

Figure 1:
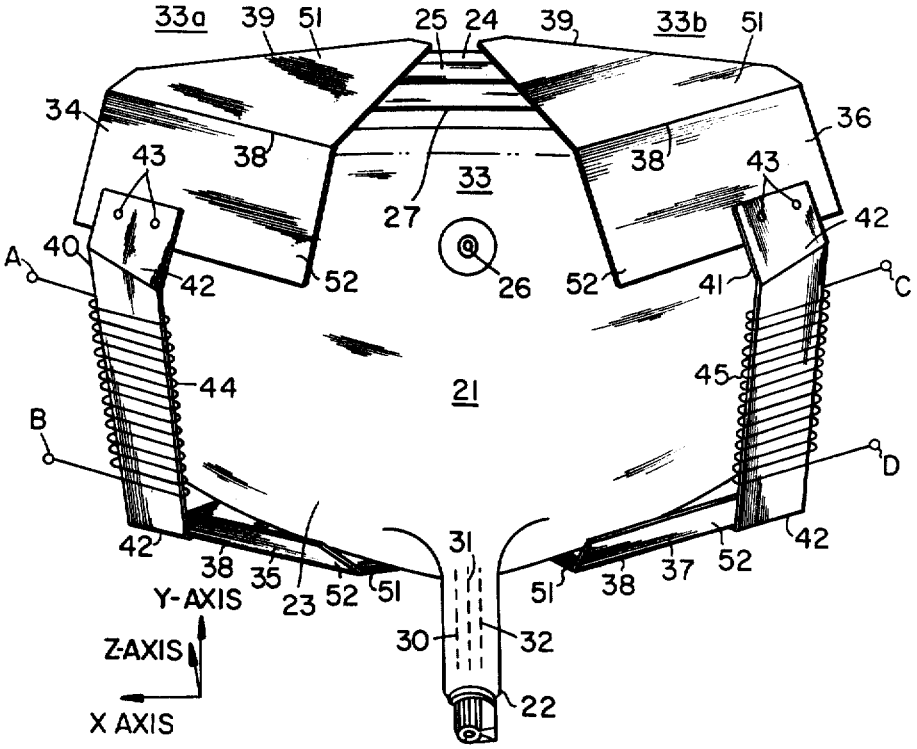
FIG. 1 illustrates a top rear elevation view of a color picture tube with a combined magnetic shielding and degaussing structure embodying the invention.
Figure 2:
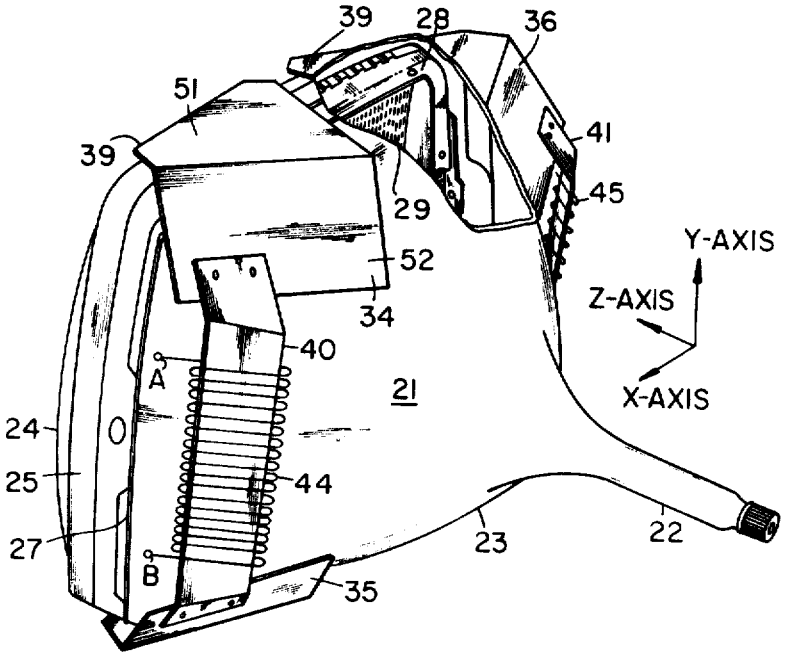
FIG. 2 illustrates an isometric side view of the picture tube and combined structure of FIG. 1 with a partial break-out view of a corner area revealing the picture tube shadow mask.

A color picture tube or cathode ray tube 21, illustrated in FIGS. 1 and 2, comprises a neck portion 22, a flared or funnel portion 23 and a faceplate portion 24. Tightly wrapped around the outside of the faceplate is a metal tension or guard band 25. Faceplate 24 is connected to the funnel 23 of color picture tube 21 along a frit seal 27. An anode button or metal pin 26 is electrically connected to the inner ultor conductive coating and protrudes outside of the picture tube envelope or wall sufficiently to provide connection to an anode cap, not illustrated, of a television receiver high voltage transformer. Secured over a metal support structure 28 inside the faceplate 24 is a metallic shadow mask 29, as illustrated in the corner break-out section of FIG. 2.

Color picture tube 21 may, for example, be of the in-line type with three in-line electron guns and associated accelerating, focusing and biasing electrodes, not shown, located in neck 22. The electron guns lie in a plane formed by the horizontal or X-axis and the longitudinal or Z-axis of the tube and produce three in-line electron beams 30, 31 and 32, which travel inside the tube envelope from neck 22 to faceplate 24, through apertures in the shadow mask 29, to strike associated blue, green and red color phosphor stripes, not shown, deposited on faceplate 24. For an in-line color picture tube 21, the phosphor stripes are vertical or Y-axis elongated stripes and the apertures in the shadow mask are rectangular and vertically elongated.

To scan a raster, the electron beams are deflected by the magnetic field produced by the vertical and horizontal deflection windings of a deflection yoke situated in a yoke housing, not shown, that is placed over neck 22 and against funnel 23. To provide for center convergence of the electron beams, a conventional static convergence device, not shown, is located over neck 22. Corner convergence is provided by appropriate selection of the deflection winding distribution or by auxiliary windings wound about the deflection yoke core.

Color purity is achieved when the electron beams appear to be deflected from the corresponding deflection centers associated with color picture tube 21. Color purity in the center of the phosphor screen is obtained with the aid of a conventional color purity device, not shown, located over neck 22. Overall color purity is obtained by correctly positioning the deflection yoke along neck 22.

Color purity errors may result from the interactions of the electron beams with magnetic fields existing inside the color picture tube other than those fields produced by the aforementioned magnetic devices and structures. For example, external stray magnetic fields such as the earth's magnetic field may undesirably move the electron beams. A magnetic shield is provided for the picture tube to prevent these external fields from penetrating the tube in a manner that will undesirably affect color purity. Metallic structures, such as shadow mask 29 and its support housing 28, may be come magnetized and thereby generate undesirable magnetic fields which affect color purity. A degaussing structure must therefore be provided which permits degaussing of any undesirably magnetized metallic picture tube components prior to the development of a picture in the television receiver.

A combined structure 33 embodying the invention, and illustrated in FIGS. 1 and 2, provides the functions of both magnetic shielding and picture tube degaussing. Located at the corners of picture tube 21 external to the envelope are magnetizable metallic shielding plates 34–37. Each metallic plate is of an extended surface area, extending from points near the center region of the funnel 23 up to points near the front of the faceplate 24. Each plate is bent along a line 38 to closely follow the curvature of the funnel and faceplate. Each plate thus includes a substantially horizontally oriented section 51 overlapping a picture tube shadow mask region and a canted flat section 52 connecting a section 51 to a strip end. A section, along a line 39, of each generally rectangularly shaped plate is cut away near the faceplate region, to prevent the plates from protruding beyond the faceplate.

Connecting the upper and lower plates on both sides of picture tube 21 are vertically directed magnetizable metallic strips of material 40 and 41, with strip 40 connecting plates 34 and 35 and strip 41 connecting plates 36 and 37. Each strip, near its upper and lower end, is bent along a line 42 to enable the strip to follow the curvature of the funnel 23. Rivets 43 attach metallic strips 40 and 41 to their associated metallic shielding plates. Thus, the combined structure 33 comprises two assemblies 33*a* and 33*b*, each of which is placed against picture tube 21. A plastic strap, not illustrated, may then be tightened around each assembly to hold the assembly against the picture tube.

Plates 34–37 and strips 40 and 41 coact to form a magnetic shield to prevent external stray magnetic fields from penetrating far enough into the tube to adversely interact with in-line electron beams 30–32. For many in-line type color picture tubes, it has been observed that color purity errors due to stray fields are relatively large at the corners of the raster. Plates 34–37 are designed to flare outwardly from the ends of strips 40 and 41 to become wider than the strips and cover relatively extensive surface areas behind the shadow mask in the corner regions of funnel 23 and faceplate 24, in regions unshielded by the shadow mask and by magnetizable structures within the color picture tube. The effects of the stray magnetic field are thus substantially reduced at the picture tube corners.

Because in-line tubes typically use vertically elongated phosphor stripes, only horizontally directed error movements will substantially affect color purity. That is to say, only those components of the stray magnetic field flux density and electron beam velocity vectors that contribute to a horizontally directed force $F_x$ on the electron beam will contribute to color purity errors. Thus, $F_x \propto v_z B_y - v_y B_z$ where the subscripts x, y, z refer respectively to the horizontal, vertical and longitudinal component of the associated electron beam velocity $\vec{v}$ or magnetic density $\vec{B}$ of the stray magnetic field, when referenced to the coordinate axes drawn in FIGS. 1 and 2. The vertical flux density component, $B_y$, of the stray magnetic field, therefore, substantially contributes to horizontally directed error movement. As the strongest component of the earth's magnetic field is the vertical component, this component contributes substantially to horizontally directed error movement.

The combined structure 33, embodying the invention, is especially suited for shielding against such vertically directed fields. Consider, for example, vertically directed stray magnetic field lines flowing towards picture tube 21, as illustrated in FIG. 2. Because the magnetic permeability of metal, such as steel sheet metal, is much greater than the permeability of air, and because of the relatively extensive projected picture tube funnel area covered by shielding plates 34 and 35, the field lines over a relatively wide area flow into plates 34 and 35. Metal plates 34 and 35 thus function as collectors of the field lines flowing in a relatively large region adjacent one side of funnel 23. Metal strip 40, because it provides a low reluctance path, substantially through metal, for the flux gathered by collector plates 34 and 35, will concentrate and collimate the field lines collected by plates 34 and 35 into the strip, thereby bypassing the stray magnetic flux away from the interior of the picture tube to provide the required magnetic shielding. Alternatively explained, since collector plates 34 and 35 and metal strip 40 concentrate the field lines to provide an increased stray field flux density in the structure, the stray field flux density adjacent the strip, such as the flux density inside picture tube 21, is substantially weakened, providing a magnetic shielding effect.

Metallic collimator strips 40 and 41, by covering portions of the sides of the funnel, provide some additional side shielding as well as functioning to concentrate the field lines collected by plates 34–37.

Figure 3:
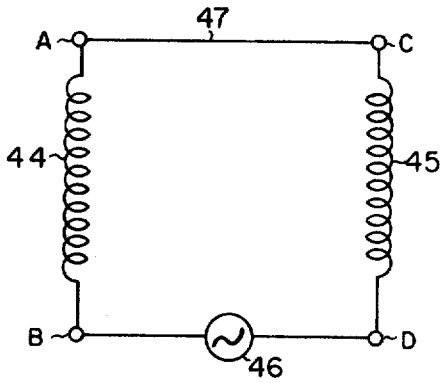
FIG. 3 illustrates an electrical schematic associated with the degaussing winding portion of the combined structure in FIGS. 1 and 2.

To provide degaussing of the shadow mask 29 and its metallic support structure 28, a degaussing winding 44 is wound around collimator strip 40 and a degaussing winding 45 is wound around collimator strip 41. As illustrated in the electrical schematic of FIG. 3, degaussing windings 44 and 45 are electrically series connected to each other and to a source of decaying alternating current voltage 46 for generating a decaying AC degaussing current in windings 44 and 45. Terminals A and C are coupled together by a conductor wire 47 and terminals B and D are coupled across voltage source 46.

With the winding senses of degaussing windings 44 and 45 as illustrated in FIG. 1, the degaussing flux generated in one of the collimator strips 40 and 41 flows vertically into the shadow mask 29 and support structure 28. A combined magnetic shielding and degaussing function is thus provided. The low reluctance path for stray fields away from the funnel interior formed by shielding elements 34–37, 40 and 41 provides at the same time a low reluctance path for degaussing flux into shadow mask 29 and support 28. With degaussing windings 44 and 45 wound around the vertical axes of the vertically oriented collimator strips 40 and 41, the degaussing flux will flow in a substantially vertical direction in shadow mask 29. The vertical components of any stray fields are substantially reduced by the degaussing action and by the shielding effect of the shadow mask.

The low reluctance of the degaussing flux path is enhanced by extending each shielding plate from the funnel region to the top or bottom of the faceplate region. With such an arrangement, the collector plates overlap the shadow mask and support structure, providing a minimum nonmetal flux path, as illustrated in the corner break-out portion of FIG. 2. The shielding plates and the shadow mask are thus separated only by the faceplate thickness.

In order to impede the flow of degaussing flux in shunt paths that undesirably bypass the shadow mask and the corners of the picture tube, the degaussing windings 44 and 45 are wound over extended lengths of collimator strips 40 and 41, rather than being arranged as short coils which are prone to develop more air shunting of the degaussing flux. Because only the corner portions of the picture tube need extensive shielding, shielding plates 34–37 need not extend all the way to the horizontal center line of the funnel. If plates 34–37 did so extend, such extension could bridge many of the conductor turns of degaussing windings 44 and 45, thereby magnetically short-circuiting these turns and preventing the degaussing flux generated by these turns from flowing into the shadow mask.

As illustrated in FIG. 1, the horizontally oriented sections 51 of the upper corner shielding plates 34 and 36 terminate near the center of the picture tube. The plates are thus separated from each other by a gap in the metal or magnetizable material of the plates. Similarly separated are the lower corner shielding plates 35 and 37. Such an arrangement facilitates the flow of degaussing flux from the shielding plates into the associated corner regions of the shadow mask 29 and support structure 28. Had the corresponding corner shielding plates been connected, much of the flux could bypass the corners and flow in the central picture tube region.

By using such a shielding arrangement as described, including relatively narrow collimator strips, the overall quantity of metal required may be reduced. Because the conductor turns of the degaussing windings are wound around relatively narrow strips of metal, the total length of conductor wire needed for a predetermined number of turns is reduced, thereby reducing the wire cross-sectional area required in order to obtain predetermined winding resistance values.

Because the combined structure provides a relatively low reluctance to the flow of the degaussing flux and a reduced shunting, fewer ampere-turns need be supplied by the degaussing windings, permitting the cross-sectional area of the collimator strips to be reduced without undesirably saturating the strips under the windings. A relatively inexpensive but low permeability metal, such as cold rolled sheet metal steel, may be used to form the shielding plates and collimator strips. A high permeability metal, such as silicon steel, that is typically used, is no longer required in order to be able to couple sufficient amounts of degaussing flux to the shadow mask to properly degauss the mask.

The degaussing flux flowing in the shielding plates 34 and 35 in the collimator strips 40 and 41 of the combined structure 33 improves the shielding ability of the combined structure. During the degaussing interval, magnetic domains within the shielding plates and collimator strips are aided by the degaussing flux into realigning parallel to the stray field such that the next stray field internal to the picture tube envelope is substantially reduced.

EXAMPLE

Color Picture Tube Used: 19 V in-line

Collector Plate 34, 35, 36, 37: Length: 7 inch; Width: 6 inch; Thickness: 14 mil; Material: Cold rolled sheet steel.

Collimator Strip 40, 41: Length: 13 inch; Width: 2 inch; Thickness: 55 mil; Material: Cold rolled sheet steel.

Degaussing Winding 44, 45: 200 turns of #28 gauge copper wire; Length of winding: 5 inch.

Peak Degaussing Current Flowing in Windings 44 and 45: 5 amperes.

What is claimed is:

1. A magnetic shielding and degaussing structure for a color picture tube having a shadow mask, comprising:

a first vertically oriented strip of magnetizable material located adjacent a side of said color picture tube;

a first magnetizable shielding plate connected to an end of said first strip and flaring outwardly from said first strip to become wider than said first strip at said end of said first strip and covering an extended surface area external to said color picture tube at a first corner of said color picture tube over a region of said shadow mask and over a funnel region extending rearwardly from said shadow mask region that are unshielded by other magnetizable structures within said color picture tube; and a first degaussing winding for generating degaussing flux with conductor turns wound around the vertical axis of said first strip of magnetizable material.

2. A structure according to claim 1, including a second magnetizable shielding plate connected to the other end of said first strip of magnetizable material and flaring outwardly from said first strip to become wider than said first strip at said other end and covering an extended surface area external to said color picture tube at a second corner of said color picture tube over a region of said shadow mask and over a funnel region extending rearwardly from said shadow mask region that are unshielded by other magnetizable structures within said color picture tube.

3. A structure according to claim 2 wherein the conductor turns of said first degaussing winding extend along the vertical axis of said first strip from the vicinity of the outwardly flaring portion of the first shielding plate to the vicinity of the outwardly flaring portion of the second shielding plate.

4. A structure according to claim 2, including a second vertically oriented strip of magnetizable material located opposite said first vertically oriented strip and adjacent a second side of said color picture tube; third and fourth magnetizable shielding plates, each connected to a respectively different one of the ends of said second strip and flaring outwardly therefrom to become wider than said second strip at the respective end of said strip, and each covering an extended surface area external to said color picture tube at a respective corner at said second side over a region of said shadow mask and over a funnel region extending rearwardly from said shadow mask region that are unshielded by other magnetizable structures within said color picture tube; and a second degaussing winding for generating degaussing flux with conductor turns wound around the vertical axis of said second strip of magnetizable material.

5. A structure according to claim 4 wherein the shielding plate at each end of said first strip is separated from the shielding plate at the corresponding end of said second strip by a gap for facilitating the flow of degaussing flux in the corner regions of said shadow mask.

6. A structure according to claim 5 wherein each of said shielding plates includes a substantially horizontally oriented section terminating at a respective one of the gaps.

7. A structure according to claim 6 wherein each of said shielding plates includes a flat section canted from said substantially horizontally oriented section and connecting said horizontally oriented section to a respective one of said first and second strips of magnetizable material.

8. A structure according to claims 1, 4 or 5 wherein said color picture tube includes three in-line electron beams, with degaussing flux flowing in said shadow mask directed mainly in a vertical direction.

9. A magnetic shielding and degaussing structure for a color picture tube having a shadow mask and faceplate, funnel and neck regions, comprising:

a magnetizable shielding plate located at each corner of said color picture tube, entirely external to said color picture tube, for collecting stray magnetic flux, each shielding plate extending over a respective region of said shadow mask and over a funnel region adjacent thereto that are unshielded by other magnetizable structures within said color picture tube;

a pair of vertically oriented magnetizable collimator strips, each connecting upper and lower corner shielding plates on a side of said color picture tube to provide a low reluctance path substantially in a magnetizable material between an upper and a lower corner shielding plate, said upper and lower corner shielding plates guiding said stray magnetic flux into said collimator strips away from the interior of said color picture tube to provide magnetic shielding for said color picture tube; and a pair of degaussing windings with conductor turns of said windings wound around the vertical axes of said collimator strips, said shielding plates cooperating with said collimator strips to form a low reluctance path for directing degaussing flux generated by said degaussing windings into said shadow mask.

10. A structure according to claim 9 wherein the conductor turns of each of said degaussing windings are wound over an extended length of the associated strip reaching the vicinity of the shielding plates.

11. A structure according to claim 10 wherein each of said magnetizable shielding plates and collimator strips is formed of a relatively low permeability sheet metal steel.

12. A structure according to claim 9 wherein said color picture tube develops three in-line electron beams traversing the interior of said tube from said neck region to said faceplate region.

13. A structure according to claim 12 wherein said degaussing flux flows vertically within said shadow mask.

* * * * *